United States Patent [19]

Aokage et al.

[11] 4,026,121

[45] May 31, 1977

[54] DEFROSTING IN OPEN SHOW CASE OF COLD-AIR-CIRCULATION TYPE

[75] Inventors: Yoshitaka Aokage; Yoshio Yamana, both of Kawasaki, Japan

[73] Assignee: Fuji Denki Seizo Kabushiki Kaisha, Japan

[22] Filed: May 17, 1976

[21] Appl. No.: 686,895

[30] Foreign Application Priority Data

May 20, 1975 Japan ..... 50-59908

[52] U.S. Cl. ..... 62/151; 62/256

[51] Int. Cl.[2] ..... F25D 21/06; A47F 3/04

[58] Field of Search ..... 62/255, 256, 151

[56] References Cited

UNITED STATES PATENTS

| | | | |
|---|---|---|---|
| 2,494,480 | 1/1950 | MacMaster | 62/256 |
| 3,287,929 | 11/1966 | Beckwith | 62/256 |
| 3,496,732 | 2/1970 | Vogel et al. | 62/256 |
| 3,827,254 | 8/1974 | MacMaster et al. | 62/256 |
| 3,850,003 | 11/1974 | Beckwith et al. | 62/256 |
| 3,937,033 | 2/1976 | Beckwith et al. | 62/256 |

*Primary Examiner*—Lloyd L. King

*Attorney, Agent, or Firm*—Robert E. Burns; Emmanuel J. Lobato; Bruce L. Adams

[57] ABSTRACT

An open show case of cold-air-circulation type having a front access opening, a passage with a cooler and an air fan for circulating cold air therethrough and forming a cold air curtain across the access opening, and at least one other air passage with an air fan for circulating air and forming another protective layer of air curtain outside of the cold air curtain is defrosted by controllably operating the fans respectively in mutually adjacent air passages to blow air in mutually opposite directions thereby to cause air to flow in short-circuited flow at passage openings at the access opening, whereby air ejected from one passage at the access opening is immediately sucked into the adjacent passage without crossing the access opening, thereby to draw in warm outside air into the cold air passage and thereby to accomplish defrosting.

6 Claims, 2 Drawing Figures

DEFROSTING IN OPEN SHOW CASE OF COLD-AIR-CIRCULATION TYPE

BACKGROUND OF THE INVENTION

This invention relates generally to open show cases or display cases of the cold-air-circulation type. More particularly, the invention concerns a method of defrosting show cases of the stated kind and an open show cases adapted to be defrosted by this method.

In an open show case of the above named cold-air-circulation type, in general, frost is deposited on parts such as a cooler and grills at an air ejection nozzle as the show case is operated for cooling, and this deposited frost eventually will give rise to clogging if it is not removed. For this reason, the cooling operation of the cooler is stopped and defrosting operation is carried out after a cooling operation of a certain time.

Heretofore, one known method accomplishing this defrosting operation in a show case of the type referred to above with two or three air flow passages has been to heat the air stream circulating through the cold-air passage containing the cooler and adjacently surrounding the commodity accommodating box by means of an electric heater installed within the cold-air passage on the inlet side of the cooler or by passing hot coolant gas through the cooler while air is caused to flow through all passages in the same state as at the time of normal cooling operation. However, the use of an electric heater increases the electric power consumption, while the use of hot coolant gas requires complicated equipment and is expensive.

SUMMARY OF THE INVENTION

It is an object of this invention to provide a method of accomplishing defrosting operation in an open show case of the type referred to above with an electric heater for defrosting of greatly reduced capacity or without any accessory defrosting equipment whatsoever.

Another and more specific object of the invention is to provide a method for defrosting operation wherein defrosting is accomplished by drawing warm outside (ambient) air into the show case and causing it to flow past parts on which frost has deposited.

Still another object of the invention is to provide an open show case adapted to be defrosted by the above stated method.

A further object of the invention is to provide a defrosting method as stated above which is inexpensive and merely requires the use of reversible motors for two air fans and a control circuit for controlling the forward-reverse operation of these motors.

According to this invention in one aspect thereof, briefly summarized, there is provided, in the defrosting of an open show case of cold-air-circulation type having: an outer cabinet with a front access opening; a commodity accommodating box disposed in the innermost part of the cabinet and having a corresponding access opening; a cold-air-circulation passage formed adjacently around the commodity box and accommodating therewithin a cooler and a first air fan for circulating cold air through the passage, which passage has at opposite sides of the access openings an ejection nozzle and a corresponding suction inlet between which a cold-air curtain is formed; and air passage means including air fan means for forming at least one layer of a cold-air-protecting air curtain outside of the cold-air curtain, an improved method of defrosting which comprises controllably operating the fans respectively in mutually adjacent air passages to blow air in mutually opposite directions thereby to cause air to flow in short-circuited flow at the passage openings at the access openings, in which flow, air ejected from one passage is immediately sucked into an adjacent passage, thereby to draw in warm outside air into the cold-air-circulation passage and thereby to melt and remove frost adhering to parts related to the cold-air-circulation passage.

According to this invention in another aspect thereof, there is provided an open show case of the cold-air-circulation type referred to above which is adapted to be defrosted by the above described method by being provided with reversible air fans in the air passages and a control circuit for controlling the operational direction of each air fan.

The nature, principle, and utility of this invention will be more clearly apparent from the following detailed description with respect to preferred embodiments of the invention when read in conjunction with the accompanying drawing, in which like parts are designated by like reference numerals and characters.

DETAILED DESCRIPTION

Figure 1:
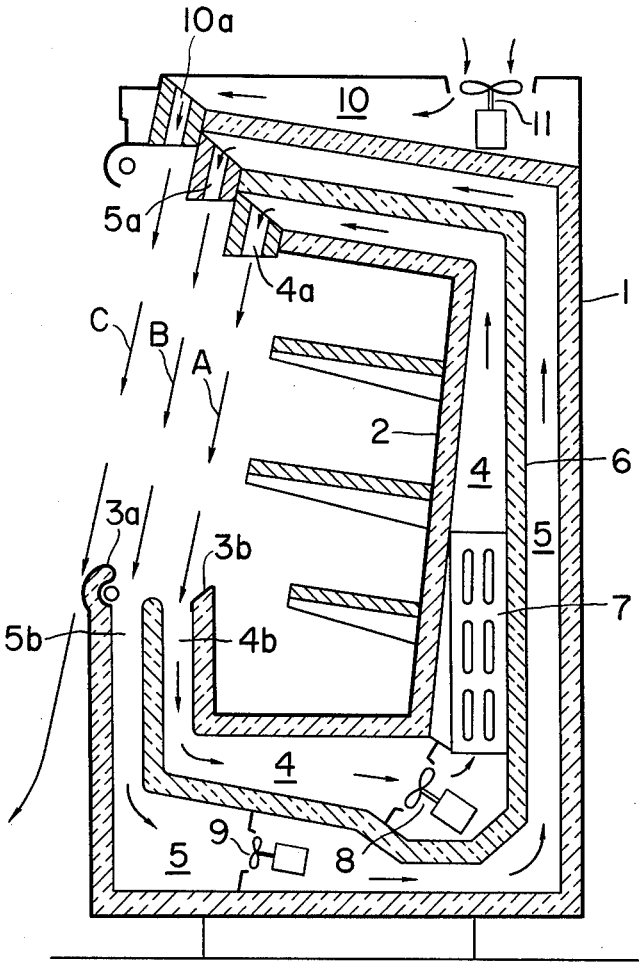
FIG. 1 is a side elevation, in vertical section, showing the essential construction of one example of an open show case according to this invention and indicating various air flows therethrough at the time of normal refrigeration operation of the show case.

Referring to the drawings, the example illustrated therein of the open show case according to this invention has an outer housing or cabinet 1, which houses therewithin a commodity accommodating box 2 defining a refrigerated chamber. The front faces of the cabinet 1 and the box 2 have access openings respectively defined and framed by rims 3*a* and 3*b* of their respective walls. Within the cabinet 1 and surrounding the commodity box 2, there is formed a passage 4 for circulation of cold air, and further outside is formed another circulation passage 5 separated from the passage 4 by a partition wall 6, the passage being for the purpose of protecting the cold air.

Within the cold-air-circulation passage 4 at the lower rear part of the box 2, there are installed a cooler 7 and a reversible first fan 8 disposed below the cooler 7. A reversible second fan 9 is installed in the passage 5 at the lower part thereof. An outside (ambient) air passage 10 is provided at the upper part of the cabinet 1, and a reversible third fan 11 is provided at the rear part of this passage 10 to draw in outside air and to send it through this passage toward the front.

Along the upper edges of the rims 3*a* and 3*b* defining the aforementioned access openings in the front faces of the open show case, air ejection nozzles 10*a*, 5*a*, and 4*a* communicating respectively with the upper front extremities of the passages 10, 5, and 4 are disposed in cascade arrangement with substantially parallel ejection directions from front to rear. Suction inlets 5*b* and 4*b* communicating respectively with the lower front extremities of the passages 5 and 4 are provided along the lower edges of the rims 3*a* and 3*b* of the access openings.

At the time of normal cooling operation of this open show case, the cooler 7 is operated for cooling, and, at the same time, the above mentioned fans 8, 9, and 11 are operated in their regular directions to deliver air currents in their respective arrow directions as indicated in FIG. 1. Consequently, across the access opening in the open show case, a cold-air curtain A is formed from the ejection nozzle 4*a* toward the suction inlet 4*b*, and a curtain B for protecting cold air is ejected and formed from the ejection nozzle 5*a* toward the suction inlet 5*b*. In addition, an outside-air curtain C is ejected and formed from the ejection nozzle 10*a*.

The cold-air curtain A cools the interior of the commodity box 2, while the cold-air-protecting air curtain B forms a thermal shield between the cold air and the outside air thereby to protect the cold air with respect to the outside air. Furthermore, the outside-air curtain C forms a thermal shield to prevent admixing of the warm outside air with the air curtains A and B and, at the same time, to prevent downward flow of air toward the region outside the lower front part of the cabinet 1 in the aisle where the customers pass to give rise to unpleasant cooling of the customers' feet.

As the cooling operation of the open show case of cold-air-circulation type as described above proceeds, frost forms on parts such as the cooler 7 and the grill of the ejection nozzle 4*a* and gives rise to clogging. For this reason, after a certain period of cooling operation, the cooling operation of the cooler 7 is stopped, and defrosting operation is carried out.

Figure 2:
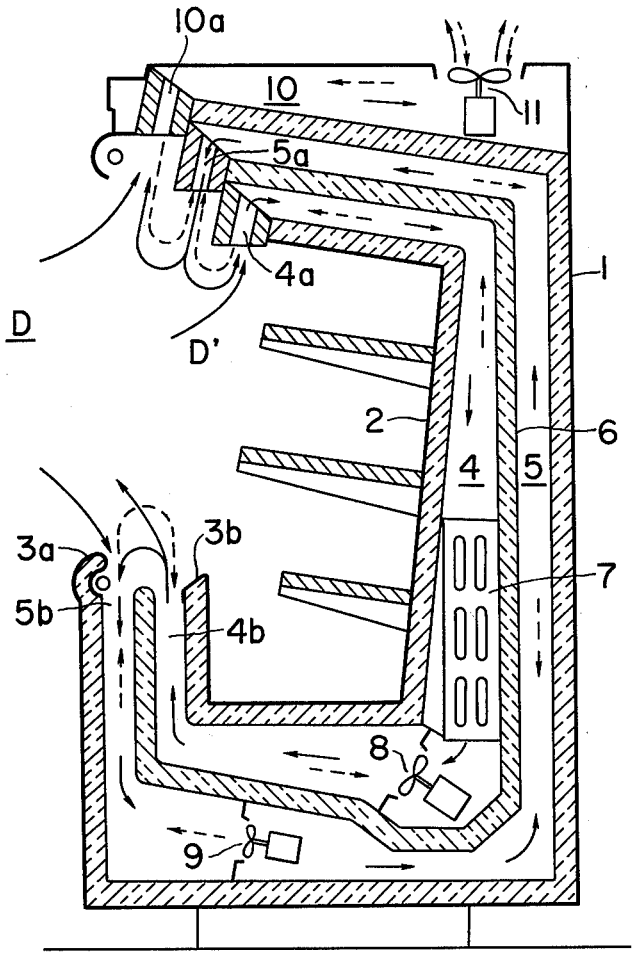
FIG. 2 is a similar side elevation of the show case, indicating various air flows therethrough at the time of defrosting.

The manner in which defrosting is accomplished in accordance with this invention will now be described in greater detail with respect to one example as illustrated in FIG. 2, which indicates the states of air flows at the time of defrosting according to the invention. In this example, the cooler 7 and the fans are connected to an operation control circuit (not shown) by which the operation of the cooler 7 can be stopped and the motors of the first and third fans 8 and 11 can be run in the reverse direction. At the time of defrosting operation, the air blowing direction of the second fan 9 is maintained the same as that at the time of cooling operation, and the motors of the first and third fans 8 and 11 installed in the passages 4 and 10 are rotated in the reverse direction thereby to blow the air in their respective reverse directions.

Accordingly, the state of flows through the air flow passages 4, 5, and 10 in the open show case become as indicated by full-line arrows in FIG. 2. More specifically, one portion of the air blown out from the passage 4 through the opening 4*b* is immediately sucked into the adjacent passage 5 through the opening 5*b* and thereby undergoes a short-circuited flow. At the ejection nozzle 5*a* of the passage 5, portions of the air flow are respectively sucked into the passages 4 and 10 as short-circuited flows.

In this manner, the air curtains A, B, and C formed in parallel upon being ejected from their respective nozzles at the time of cooling operation as indicated in FIG. 1 are disturbed, and portions of air flows at the ejection nozzles and suction inlets of the passages 4, 5, and 10 become short-circuited into neighboring passages. As a result, in the passage 4 for circulation of cold air, the flowing air no longer forms an air curtain to undergo circulation within the passage 4, and warm outside air D in the neighboring region outside the cabinet 1 of the show case is drawn in as indicated by the arrow D′ through the front opening in the cabinet and flows through the passage 4. This drawn-in flow D′ of warm outside air melts and removes the frost adhering to the grills installed at the ejection nozzle and suction inlet and the cooler 7 in the passage 4.

This defrosting operation with the use of warm outside air is highly effective, and, when carried out for the ordinary defrosting time, it accomplishes complete defrosting without the need for heating with conventional defrosting heater or hot coolant gas flow or with the use of only a defrosting heater of very small capacity.

In another embodiment of this invention, defrosting operation is carried out by maintaining the air blowing directions of the first and third fans 8 and 11 in an open show case of three-layer air-curtain type of the construction illustrated in FIG. 1 the same as in the cooling operation and reversing the air blowing direction of the second fan 9 is reversed, as indicated by intermittent-line arrows in FIG. 2. In this defrosting operation, also, the air curtains in the cooling operation are disturbed as described hereinbefore, and warm outside air is positively drawn into and flows through the passage 4 for cold air circulation thereby to accomplish effective defrosting.

Furthermore, this invention is practically applicable not only to open show cases of the three-layer air-curtain type but also to other open show cases such as, for example, those of the two-layer air-curtain type, such as would be obtained by deleting one of the air curtains B and C in the open shown case illustrated in FIG. 1.

As described above, this invention provides a defrosting method and means having the advantageous feature of ample defrosting effect with only warm outside air and without the use of special defrosting equipment such as a heater or means for passing hot coolant gas as in conventional defrosting systems or with the use of such equipment of very small size and capacity.

We claim:

1. In the defrosting of an open show case of cold-air-circulation type having: a case structure including an outer cabinet and a cooled commodity box disposed in the innermost part of said cabinet and adapted to hold commodities in cooled state, said case structure having a front opening for access from the outside to said commodities; a cold-air-circulation passage means formed adjacently around said box and provided therewithin with air cooling means and first air circulation means for circulating cold air through said passage means, said passage means having, at respectively opposite ends thereof and at opposite upper and lower sides of said access opening, ejection nozzle means and corresponding suction inlet means between which a cold-air curtain is formed when air is thus circulated in normal cooling operation; and air passage means provided with second air circulation means and having air ejection nozzle means and corresponding suction inlet means for forming at least one protective air curtain outside of said cold-air curtain for shielding said cold-air curtain from the outside air, an improved defrosting method which comprises controllably stopping the operation of said air cooling means and operating said first and second air circulation means respectively in mutually adjacent air passage means to circulate air in mutually opposite directions thereby to cause air to flow in short-circuited flow at said ejection nozzle means and suction inlet means, in which flow, air ejected from one passage means is immediately sucked into an adjacent passage means without forming an air curtain across the access opening, thereby to draw warm outside air into said cold-air-circulation passage means, and thereby to melt and remove frost adhering to parts related to said passage means.

2. In the defrosting of an open show case of cold-air-circulation type having: a case structure including an outer cabinet and a cooled commodity box disposed in the innermost part of said cabinet and adapted to hold commodities in cooled state, said case structure having a front opening for access from the outside to said commodities; a first passage formed adjacently outside of and around said box and provided therewithin with air cooling means and first air circulation means for circulating cold air through said passage, said passage having, at respectively opposite ends thereof and at opposite sides of said access opening, an ejection nozzle and a corresponding suction inlet between which a cold-air curtain is formed when cold air is thus circulated in normal cooling operation, a second passage provided with second air circulation means and having, at respectively opposite ends thereof and at opposite sides of said access opening, an ejection nozzle and a corresponding suction inlet for forming a protective second air curtain outside of said cold-air curtain; and a third air passage provided with third air circulation means and having at one end thereof an opening communicating with the outside air and at the other end thereof an ejection nozzle for blowing a protective third air curtain outside of said second air curtain, an improved defrosting method which comprises controllably stopping the operation of said air cooling means, operating said second air circulation means in the same forward direction as in said normal cooling operation, and operating said first and third air circulation means in respective directions reverse to those in normal cooling operation thereby to cause a portion of air in said first passage to flow out of said suction inlet thereof and be immediately sucked in short-circuited flow into said suction inlet of said second passage and portions of air in said second passage to flow out of said ejection nozzle thereof and be immediately sucked in short-circuited flow into said ejection nozzles of said first and third passages and thereby to draw warm outside air into said passages to accomplish defrosting.

3. In the defrosting of an open show case of cold-air-circulation type having: a case structure including an outer cabinet and a cooled commodity box disposed in the innermost part of said cabinet and adapted to hold commodities in cooled state, said case structure having a front opening for access from the outside to said commodities; a first passage formed adjacently outside of and around said box and provided therewithin with air cooling means and first air circulation means for circulating cold air through said passage, said passage having, at respectively opposite ends thereof and at opposite sides of said access opening, an ejection nozzle and a corresponding suction inlet between which a cold-air curtain is formed when cold air is thus circulated in normal cooling operation; a second passage provided with second air circulation means and having, at respectively opposite ends thereof and at opposite sides of said access opening, an ejection nozzle and a corresponding suction inlet for forming a protective second air curtain outside of said cold-air curtain; and a third air passage provided with third air circulation means and having at one end thereof an opening communicating with the outside air and at the other end thereof an ejection nozzle for blowing a protective third air curtain outside of said second air curtain, an improved defrosting method which comprises controllably stopping the operation of said air cooling means, operating the first and third air circulation means in the same forward directions as in said normal cooling operation, and operating said second air circulation means in the direction reverse to that in normal cooling operation thereby to cause a portion of air in said second passage to flow out of said suction inlet thereof and be immediately sucked in short-circuited flow into said suction inlet of said first passage and portions of air in said first and third passages to flow out of respective ejection nozzles thereof and be immediately sucked in short-circuited flow into said ejection nozzle of said second passage and thereby to draw warm outside air into said passages to accomplish defrosting.

4. In an open show case of cold-air-circulation type having: a case structure including an outer cabinet and a cooled commodity box disposed in the innermost part of said cabinet and adapted to hold commodities in cooled state, said case structure having a front opening for access from the outside to said commodities; a cold-air-circulation passage means formed adjacently around said box and provided therewithin with air cooling means and first air circulation means for circulating cold air through said passage means, said passage means having at respectively opposite ends thereof, and at opposite sides of said access opening, ejection nozzle means and corresponding suction inlet means between which a cold-air curtain is formed when air is thus circulated in normal cooling operation; and air passage means provided with second air circulation means and having air ejection nozzle means and corresponding suction inlet means for forming at least one protective air curtain outside of said cold-air curtain for shielding said cold-air curtain from the outside air, the improvement wherein the air circulation means in at least one of said passage means is reversible in air circulating direction, and wherein there is provided means operable at the time of defrosting of the show case to stop the operation of said air cooling means and operating said first and second air circulation means respectively in mutually adjacent air passage means to circulate air in mutually opposite directions thereby to cause air to flow in short-circuited flow at said ejection nozzle means and suction inlet means, in which flow, air ejected from one passage means is immediately sucked into an adjacent passage means without forming an air curtain across the access opening, thereby to draw warm outside air into said passage means and thereby to accomplish defrosting.

5. In an open show case of cold-air-circulation type having: a case structure including an outer cabinet and a cooled commodity box disposed in the innermost part of said cabinet and adapted to hold commodities in cooled state, said case structure having a front opening for access from the outside to said commodities; a first passage formed adjacently outside of and around said box and provided therewithin with air cooling means and first air circulation means for circulating cold air through said passage, said passage having, at respectively opposite ends thereof and at opposite sides of said access opening, an ejection nozzle and a corresponding suction inlet between which a cold-air curtain is formed when cold air is thus circulated in normal cooling operation; a second passage provided with second air circulation means and having, at respectively opposite ends thereof and at opposite sides of said access opening, an ejection nozzle and a corresponding suction inlet for forming a protective second air curtain outside of said cold-air curtain; and a third air passage provided with third air circulation means and having at one end thereof an opening communicating with the outside air and at the other end thereof an ejection nozzle for blowing a protective third air curtain outside of said second air curtain, the improvement wherein said first and third air circulation means are reversible in respective air circulations directions thereof, and wherein there is provided means operable at the time of defrosting of the show case to stop the operation of said air cooling means, operating said second air circulation means in the same forward direction as in said normal cooling operation, and operating said first and third air circulation means in respective directions reverse to those in normal cooling operation thereby to cause a portion of air in said first passage to flow out of said suction inlet thereof and be immediately sucked in short-circuited flow into said suction inlet of said second passage and portions of air in said second passage to flow out of said ejection nozzle thereof and be immediately sucked in short-circuited flow into said ejection nozzles of said first and third passages and thereby to draw warm outside air into said passages to accomplish defrosting.

6. In an open show case of cold-air-circulation type having: a case structure including an outer cabinet and a cooled commodity box disposed in the innermost part of said cabinet and adapted to hold commodities in cooled state, said case structure having a front opening for access from the outside to said commodities; a first passage formed adjacently outside of and around said box and provided therewithin with air cooling means and first air circulation means for circulating cold air through said passage, said passage having, at respectively opposite ends thereof and at opposite sides of said access opening, an ejection nozzle and a corresponding suction inlet between which a cold-air curtain is formed when cold air is thus circulated in normal cooling operation; a second passage provided with second air circulation means and having, at respectively opposite ends thereof at opposite sides of said access opening, an ejection nozzle and a corresponding suction inlet for forming a protective second air curtain outside of said cold-air curtain; and a third air passage provided with third air circulation means and having at one end thereof an opening communicating with the outside air and at the other end thereof an ejection nozzle for blowing a protective third air curtain outside of said second air curtain, the improvement wherein said second air circulation means is reversible in the air circulation direction thereof, and wherein there is provided means operable at the time of defrosting of the show case to stop the operation of said air cooling means, operating the first and third air circulation means in the same forward directions as in said normal cooling operation, and operating said second air circulation means in the direction reverse to that in normal cooling operation thereby to cause a portion of air in said second passage to flow out of said suction inlet thereof and be immediately sucked in short-circuited flow into said suction inlet of said first passage and portions of air in said first and third passages to flow out of respective ejection nozzles thereof and be immediately sucked in short-circuited flow into said ejection nozzle of said second passage and thereby to draw warm outside air into said passages to accomplish defrosting.

* * * * *